United States Patent [19]

Patterson

[11] 4,454,956

[45] Jun. 19, 1984

[54] TAMPER INDICATING COMPOSITE TAPE CLOSURE

[75] Inventor: Richard A. Patterson, Woodbury, Minn.

[73] Assignee: Minnesota Mining & Manufacturing Company, St. Paul, Minn.

[21] Appl. No.: 494,854

[22] Filed: May 16, 1983

[51] Int. Cl.[3] ..... B65D 41/32

[52] U.S. Cl. ..... 220/214; 229/7 R; 215/250; 220/359

[58] Field of Search ..... 220/214, 359, 266; 229/7 R; 215/232, 250, 253

[56] References Cited

U.S. PATENT DOCUMENTS

| | | | |
|---|---|---|---|
| 1,006,087 | 10/1911 | Hertzberg | 215/250 |
| 3,389,827 | 6/1968 | Abere et al. | 220/53 |
| 3,896,965 | 7/1975 | Cornell | 220/359 |
| 3,923,198 | 12/1975 | Brochman | 220/359 |
| 3,927,793 | 12/1975 | Langen | 229/7 R X |

*Primary Examiner*—Steven M. Pollard

*Attorney, Agent, or Firm*—Donald M. Sell; James A. Smith; John C. Barnes

[57] ABSTRACT

A tape closure system for a can end having a portion thereof adhered to the can end about a pour opening, a plait formed in the free end of said tape and a sealing tape to hold the tape in folded position until sufficient force is applied to the free end of the tape to tear the sealing tape providing thereby an indication that the closure has been tampered with earlier.

7 Claims, 3 Drawing Figures

TAMPER INDICATING COMPOSITE TAPE CLOSURE

BACKGROUND OF THE INVENTION

1. Field of the Invention

This invention relates to an improvement in a closure for a container, and in one aspect, to an improved tamper indicating closure utilizing polymeric tape material to seal the opening in a metal can end for a beverage container.

2. Description of the Prior Art

The use of polymeric tape materials which are bonded to a preformed metal can end circumjacent to a pour opening are well known and such closures seal the opening until such time as it is desired to open the container by grasping a tab formed at one end of the tape closure and peeling the closure from the can end exposing the opening. If a pressure-sensitive adhesive is used on the tape construction for adhering the closure tape to the exterior of the can end it may be possible to peel the tape from the can end sufficiently to expose the opening and then reseal the tape to the can end so that it would not be readily noticeable. Such a tape closure utilizing a pressuresensitive adhesive sealing tape is disclosed in U.S. Pat. No. 3,389,827, issued June 25, 1968, to Abere et al, and assigned to the assignee of this application.

When using such closure tapes, it is desirable to have some way for the consumer to readily determine whether or not the container has been opened at the time of purchase. One such indicating device is disclosed in U.S. Pat. No. 3,923,198, issued Dec. 2, 1975, to Brochman and assigned to the assignee of this application. In this patent the tape closure includes a tape at least a portion of which opacifies when stressed such that the use of a suitable tape provides a change in the color of the tape providing a visual indication that the closure has been tampered with and one which would readily be noticeable by the consumer.

Another tamper indicating tape closure is disclosed in copending application serial No. 380,517, filed May 21, 1982, for Brochman and Patterson, and assigned to the assignee of this application, which application discloses a tape closure which is bonded to a can end over the pour opening and each end of the tape is folded back upon itself. At one end the closure tape is folded back over the entire sealing portion to form a tab and is bonded to a short length of the closure tape folded back at the other end such that the tab end of the closure tape is folded over and bonded to the short length adhered to the can end. The closure tape is perforated along the fold at the other end such that upon lifting the tab end the short length of closure tape is broken along the perforation. This closure leaves the tab free from the can end and there is a noticable breaking of the tape at the perforation indicating that the tab as been pulled loose from its initially anchored fixed position to alert the consumer that the tab has been lifted from the can end.

SUMMARY OF THE INVENTION

The present invention has as an object the provision of a tape closure for beverage can ends which utilizes a relatively small length of tape and which will provide indication of tampering with the closure at the point of purchase.

In the tape closure of the present invention the closure tape is adhered to the can end circumjacent the pour opening and has the tab end of the tape folded transversely upon itself to form a plait, shortening the tape. A second tape is used to hold the folded closure tape in its folded position. The second tape is perforated or frangible such that by grasping the tab end of the folded tape and pulling the same causes the frangible tape to break or tear and the fold can be pulled out of the closure tape.

The present invention thus comprises an improved tape closure for a can end formed of metal and having a pour opening. The closure is formed with means for restricting unidentifiable opening of the container and comprises an external closure tape having a major portion covering said pour opening and being adhered to the can end circumjacent the pour opening and having an extended end with means defining a pull tab which end is formed with a plait extending transversely of the tape to shorten the extended end of the tape. A frangible sealing tape extends transversely of the extended end portion and covers the plait to hold the tape in the folded position. The sealing tape is preferably perforated along its length and adjacent the fold line in the closure tape, whereby tension on the extended tab will cause the sealing tape to tear adjacent the fold line to extend the tape and uncover the folded tape portion. Indicia may be printed on the tape under the plait.

The tear in the sealing tape clearly indicates the pull tab has received sufficient tension to permit a rupturing of the seal and a tampering with the closure.

BRIEF DESCRIPTION OF THE DRAWINGS

The present invention will be further described with reference to the accompanying drawing wherein:

FIG. 3 is a perspective view of the can end with the closure partially open as evidence if it has been tampered with.

DESCRIPTION OF THE PREFERRED EMBODIMENT

Figure 1:
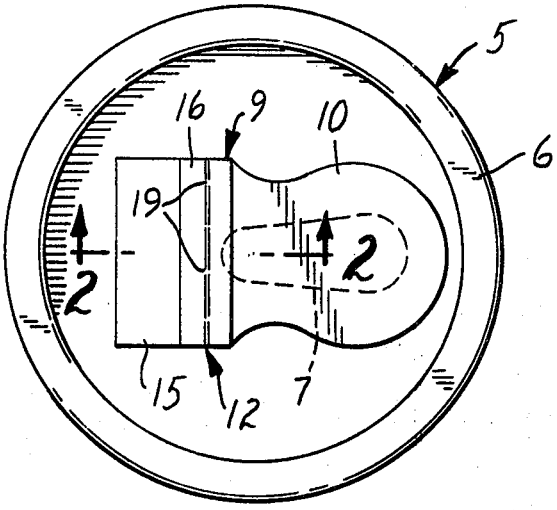
FIG. 1 is a plan view of a can end having a tape closure constructed according to the present invention.

The tape closure of the present invention provides a closure which performs the function of hermetically sealing the pour opening in a container end while providing in addition thereto an indicator to determine whether or not there has been an opening or attempted opening of the container. The tape closure of the present invention is adapted for use on a container or can end 5 formed of metal and having a peripheral flange 6 for seaming the can end 5 to a container and having a pour hole 7 cut in the can end.

The tape closure 9 comprises an exterior closure tape 10 having a major portion adhered as by an adhesive coating 11 firmly to the exterior surface of the can end 5 circumjacent the pour hole 7. The closure tape 10 has a plait 12 folded in the free end and formed by folding the exterior closure tape 10 back upon itself and then being formed with a second fold line 13 closely spaced to the first fold line to again fold it back upon itself effectively to shorten the length of the tape and provide the plait which covers a short length of the tape, one-eight to one-quarter inch, defining an indicia-bearing surface 14. The tape closure 9 further comprises means in the form of an extended end to define a pull tab 15. As illustrated, the tab 15 is formed by a length of tape being adhered by the adhesive coating 11 to the exterior tape adjacent the free end thereof to extend beyond the plait.

Sealing the fold in the exterior tape is a strip of sealing tape 16 which extends transversely of the exterior closure tape 10 adjacent the plait and covering the second fold at the fold line 13. The sealing tape 16 is perforated along the fold line 13 providing a series of thin narrow continuities 19 which tear or break when tension is applied to the tab 15 in a direction transverse to the direction of the perforation.

Figure 3:
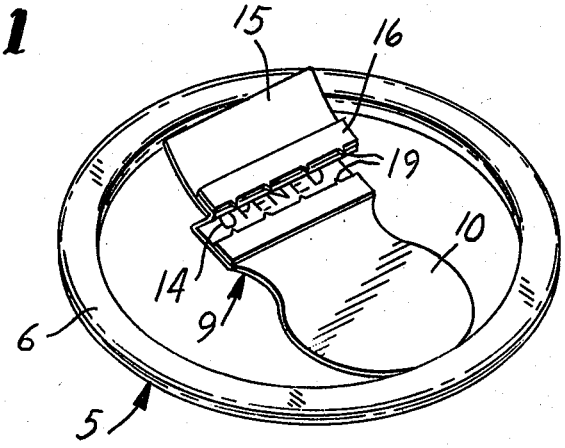
Figure 2:
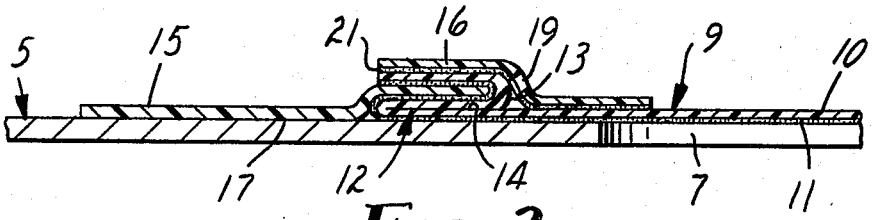
FIG. 2 is a fragmentary vertical sectional view of the can end of FIG. 1.

As indicated in FIG. 3, when the user grasps the tab 15 and applies tension on the same to peel the exterior closure tape 10 from the can end, the application of the tension first tears the sealing tape 16 at the areas 19, thus permitting the plait to be unfolded and the exterior closure tape to lengthen. The application of further force will permit the tape to be peeled from the exterior surface of the can end 5 to open the pour hole 7.

Indicia may be printed on the exterior tape 10 in the plait or surface 14 as illustrated to provide a visual indication that the closure has been tampered with to the extent of being at least partially opened. This indication is accomplished by applying the word "opened" on the indicia surface 14. Further, it will be visually evident that the sealing tape 16 has been torn at the areas 19 to provide a graphic mechanical indication that the container closure has been handled.

The tape closure of the present invention may be constructed to utilize a strong, flexible, nonstretchy backing member for the exterior closure tape which may be a material such as polyethylene terephthlate which has been vapor coated with a thin layer of metal to produce opacity and improve the impermeability of the backing. The backing member is preferably 1 to 10 mils in thickness and should be capable of being pulled back upon itself without rupture. The vapor coating is aluminum coated with a protective coat of polyester resin. The adhesive coating 11 on the closure tape 10 is a pressure-sensitive adhesive. The adhesive may be a thermally activated adhesive. Examples of the exterior closure tape 10 and adhesive 11 are described in U.S. Pat. No. 3,389,827, assigned to the assignee of this application and incorporated by reference. A tape is available from 3M, St. Paul, Minnesota, the assignee of this application, and is identified as "Scotch-tab" brand peel-open closure tape YR-8019.

The grip tab tape 15 is preferably formed of a tough polymeric film. A preferred material for such a film 15 is a strip of 3.5 mil polyethylene having good adhesion to adhesive 11 on one surface and the other surface, generally designated with reference numeral 17, having a low energy surface such as one having a release coating to release from the adhesive 11 on said one surface in the plait. The adhesion between surface 17 of the film 15 and the adhesive 11 of tape 10 must be less in peel strength than the adhesion between the adhesive 11 and the can end 5.

The sealing tape 16 is preferably a flexible polymeric film backing coated on one surface with a pressure-sensitive adhesive 21 to hold the plait together along the fold line 13. The backing is preferably a biaxially oriented polypropylene film between 1.0 and 1.6 mils thick coated with a block copolymer pressure-sensitive adhesive and skip cut to form the perforation. Such a tape is also available from 3M, St. Paul, Minnesota under the identification "Scotch" brand box sealing tape No. 373. Alternatively, the seaing tape 16 may be 1.0 mil polyethylene such as "Scotchtab" brand raw edge protection tape YR-8015 available from 3M, the assignee of this application. This tape, YR-8015 would not need to be skip cut to tear adjacent the fold line 13. The sealing tape 16 may also be bonded by pressure to the exterior closure tape 10 from which the preformed portions of such closure tape 10 are cut and then applied to the can end 5.

If the exterior closure tape 10 is formed with a pressure sensitive adhesive according to the disclosure of U.S. Pat. No. 3,389,827, the adhesive coated surface 11 holds the plait in the exterior closure tape 10 and holds the pull tab closely adjacent the plane of the can end 5.

Having described the present invention with reference to a preferred embodiment as illustrated in the accompanying drawing, it is to be remembered that the scope of this invention is defined by the appended claims.

I claim:

1. A tape closure for a can end formed of metal and having a pour opening, said closure comprising an exterior closure tape having a portion thereof adapted to adhere to the can end and cover a said pour opening, one end of said exterior tape being free of the can end, means on said free end defining a pull tab, said exterior closure tape being folded to form a plait in the tape to shorten said free end, and a sealing tape adhered to said exterior closure tape along said plait to maintain said tape in a folded condition, said sealing tape being formed to tear upon excessive tensional force being applied to said pull tab in a direction transverse to said plait to open said plait.

2. A tape closure according to claim 1 wherein said sealing tape comprises a length of material adhered to said exterior closure tape across the fold line defining said plait and having a perforation formed in said sealing tape in a direction transverse to said exterior closure tape in a position adjacent said fold line.

3. A tape closure according to claim 2 wherein said means defining a pull tab comprises a length of tape adhered to the free end of said exterior closure tape.

4. A tape closure according to claim 1 wherein said exterior closure tape comprises a strong, flexible, nonstretchy material having a coating of pressure-sensitive adhesive thereon and which adhesive coating in the area of said plait holds the free end of said exterior closure tape in the folded position.

5. A tape closure according to claim 4 wherein said sealing tape comprises a length of material adhered to said exterior closure tape across the fold line defining said plait and having a perforation formed in said sealing tape in a direction transverse to said exterior closure tape in a position adjacent said fold line.

6. A tape closure according to claim 5 wherein said means defining a pull tab comprises a length of tape adhered to the free end of said exterior closure tape.

7. A tape closure according to claim 1 wherein the plait and sealing tape protect an area of said closure tape from view and said area has indicia imprinted thereon.

* * * * *